United States Patent [19]

Yamada

[11] 4,329,544

[45] May 11, 1982

[54] SOUND REPRODUCTION SYSTEM FOR MOTOR VEHICLE

[75] Inventor: Akitoshi Yamada, Daito, Japan

[73] Assignee: Matsushita Electric Industrial Co., Ltd., Osaka, Japan

[21] Appl. No.: 150,659

[22] Filed: May 16, 1980

[30] Foreign Application Priority Data

May 18, 1979 [JP] Japan ..... 54-61847

[51] Int. Cl.[3] ..... H04R 5/04

[52] U.S. Cl. ..... 179/1 VE; 179/1 G; 179/1 GP

[58] Field of Search ..... 179/1 VE, 1 VL, 1 G, 179/1 GP, 1 GA, 1 D, 1 J

[56] References Cited

U.S. PATENT DOCUMENTS 3,670,106 6/1972 Orban ..... 179/1 GP 4,219,696 8/1980 Kogure et al. ..... 179/1 GP

*Primary Examiner*—Joseph A. Popek

*Attorney, Agent, or Firm*—Spencer & Kaye

[57] ABSTRACT

A sound reproduction system for a motor vehicle in which two channel signals are applied to two loudspeakers provided in the passenger compartment to reproduce the signals. The system includes a transfer function converting circuit for converting transfer functions between a listener and the first and second speakers into different transfer functions in different directions from those to the first and second speakers, a delay circuit for compensating for a distant difference between the listener and the first and second speakers, and a reverberation circuit for providing reverberation to two channel input signals, whereby a feeling of a widened sound region is obtained even in a small passenger compartment.

4 Claims, 9 Drawing Figures

SOUND REPRODUCTION SYSTEM FOR MOTOR VEHICLE

SUMMARY OF THE INVENTION

The present invention relates to a sound reproduction system for a motor vehicle which is used in the passenger compartment and, more particularly, to a sound reproduction system for a motor vehicle which provides a feeling of a wide sound region even in a small motor vehicle passenger compartment.

DESCRIPTION OF THE PREFERRED EMBODIMENTS

Figure 1:
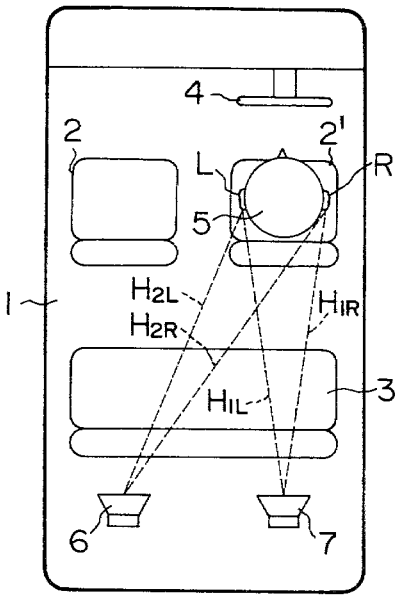
FIG. 1 PRIOR ART
FIG. 1 is a schematic diagram of a conventional sound reproduction system for a motor vehicle.

Referring to FIG. 1, there is schematically shown a conventional sound reproduction system for a motor vehicle. In FIG. 1, reference numeral 1 designates the passenger compartment of a motor vehicle, 2 and 2' front seats in the compartment 1, 3 a rear seat; 4 a steering wheel, 5 a driver, 7 and 6 loud-speakers disposed on the right and left sides behind the rear seat 3, respectively. The driver 5 hears the sounds from the right and left loud-speakers 7 and 6. In FIG. 1 $H_{1L}$ and $H_{1R}$ respectively designate transfer functions between the loud-speaker 7 and the left ear L of the driver 5, and between the loud-speaker 7 and the right ear R. $H_{2L}$ and $H_{2R}$ represent transfer functions respectively between the loud-speaker 6 and the left ear L of the driver 5, and between the loud-speaker 6 and the right ear R. When a signal $A_S$ is applied to the speakers 6 and 7, the sound pressure applied to the right ear R and the left ear L of the driver 5 are $$P_R = A_S \cdot (H_{1R} + H_{2R}) \qquad (1)$$
$$P_L = A_S \cdot (H_{1L} + H_{2L})$$

The equation (1) may also be expressed by a matrix:

$$\begin{bmatrix} P_R \\ P_L \end{bmatrix} = \begin{bmatrix} H_{1R} & H_{2R} \\ H_{1L} & H_{2L} \end{bmatrix} A_S \qquad (2)$$

Since the passenger compartment is generally small, the paths of the sounds which are radiated from the speakers 6 and 7, which are reflected on the wall of the car room 1, and then reach the right and left ears L and R of the driver 5, are short, with the result that the reflected sound has a short delay time with respect to the direct sound from the speakers 6 and 7 to the ears L and R of the driver 5. For this reason the conventional sound reproduction system has a drawback in that it can not provide a feeling of a wide sound region in the passenger compartment. Further, in the conventional system, the relative distances of the driver 5 to the speakers 6 and 7 are different. Therefore, the sound image recognized by the driver 5 is dominated by the speaker 7, so that the extension of the sound field is restricted to a narrow range just behind the driver 5. Consequently, the driver 5 feels an insufficient sound image extension.

The object of the present invention is to provide a sound reproduction system which provides to a listener the feeling of a wide sound field even within a narrow motor vehicle passenger compartment.

The present invention eliminates the abovementioned defects and provides the same sound effect as when the loud-speakers 6 and 7 were displaced outwardly.

Figure 2:
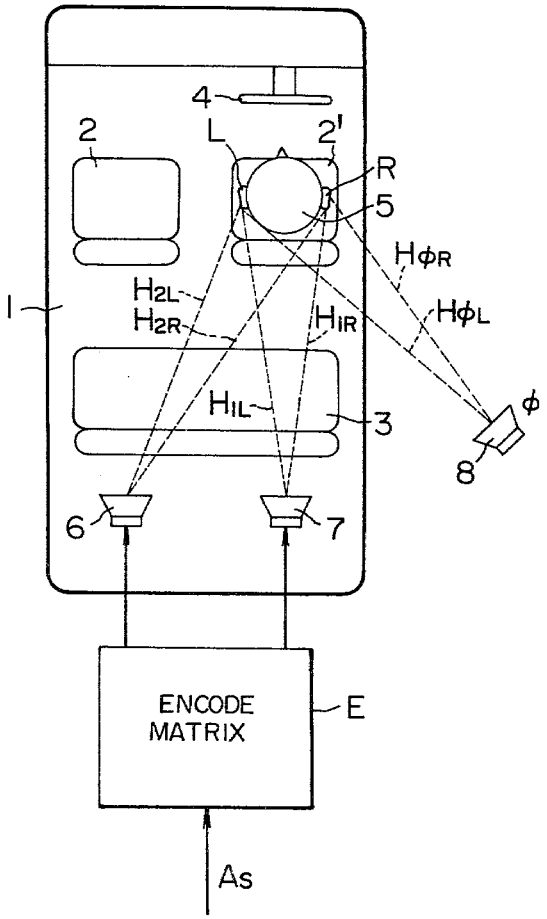
FIG. 2 is a schematic diagram for illustrating a principle of the present invention.

In FIG. 2, when a speaker 8 is disposed at a position, $\phi$, the sound pressures $P_R'$ and $P_L'$ applied to both ears of the driver 5 from the speaker 8 are expressed by $$\begin{bmatrix} P_R' \\ P_L' \end{bmatrix} = \begin{bmatrix} H_{\phi R} \\ H_{\phi L} \end{bmatrix} A_S \qquad (3)$$

where $H_{\phi R}$ and $H_{\phi L}$ are transfer functions between the right and left ears of the driver 5 and the speaker 8.

On the other hand, when the signal $A_S$ is applied to the speakers 6 and 7 through an encode matrix [E] constituted by an electric circuit, sound pressures $P_R''$ and $P_L''$ sensed by both ears are $$\begin{bmatrix} P_R'' \\ P_L'' \end{bmatrix} = \begin{bmatrix} H_{1R} & H_{2R} \\ H_{1L} & H_{2L} \end{bmatrix} \times [E] \times A_S \qquad (4)$$

If the equations (3) and (4) are exactly equal to each other, the driver 5 feels as if he hears the sound from the speaker 8, although he actually hears the sounds from the speakers 6 and 7. The encode matrix [E] which makes the equations (3) and (4) exactly equal is $$[E] = \frac{1}{1 - \frac{H_{2R} \cdot H_{1L}}{H_{1R} \cdot H_{2L}}} \times \left\{ 1 - \frac{H_{2R} \cdot H_{\phi L}}{H_{2L} \cdot H_{\phi R}} \right\} \times \frac{H_{\phi R}}{H_{1R}} \times \begin{bmatrix} 1 & \\ \frac{H_{1R} \cdot H_{\phi L} - H_{1L} \cdot H_{\phi R}}{H_{2L} \cdot H_{\phi R} - H_{2R} \cdot H_{\phi L}} \end{bmatrix} \qquad (5)$$

Figure 3:
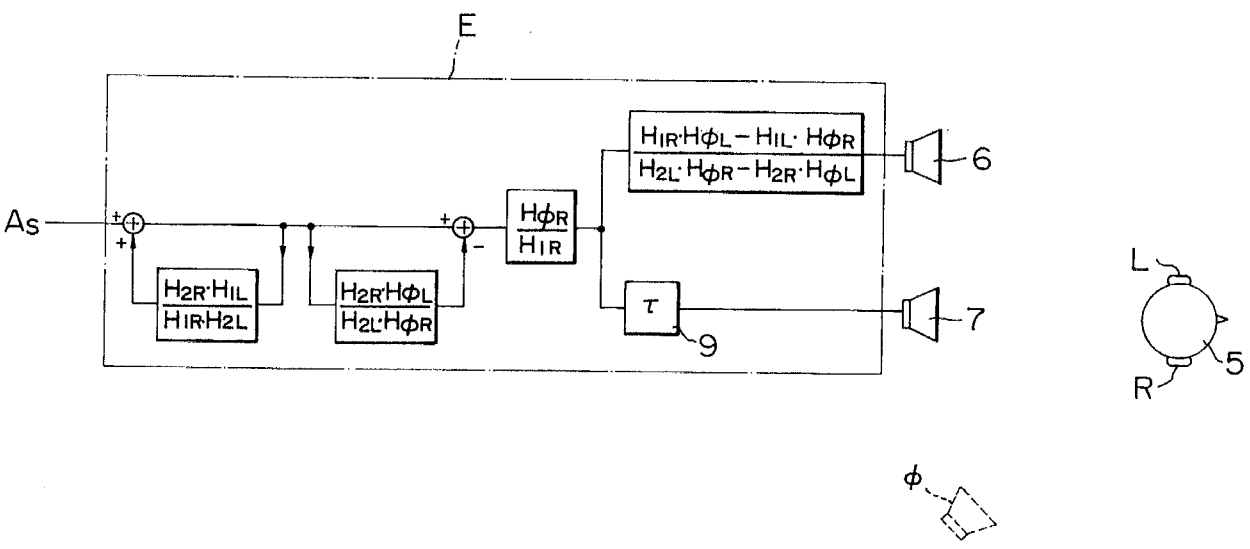
FIG. 3 is a block diagram of a basic construction of the present invention.

The equation (5) may be expressed by the circuit construction shown in FIG. 3. In the equation (5), $$\frac{1}{1 - \frac{H_{2R} \cdot H_{1L}}{H_{1R} \cdot H_{2L}}}$$

represents a feedback circuit with a feedback loop of $$\frac{H_{2R} \cdot H_{1L}}{H_{1R} \cdot H_{2L}}.$$

When hearing the sounds produced from the speakers 6 and 7 supplied with the signal $A_S$ through the circuit of the block diagram shown in FIG. 3, the driver feels as if the sound is radiated from the position $\phi$, so that the sound field is extended. A delay circuit 9 is used for compensating for any difference between the distances of the driver 5 to the speakers 6 and 7.

The experiment conducted by the inventor showed that satisfactory extension of the sound field could be obtained without providing the blocks $$\frac{H_{2R} \cdot H_{1L}}{H_{1R} \cdot H_{2L}} \text{ and } \frac{H_{2R} \cdot H_{\phi L}}{H_{2L} \cdot H_{\phi R}}.$$

Figure 4:
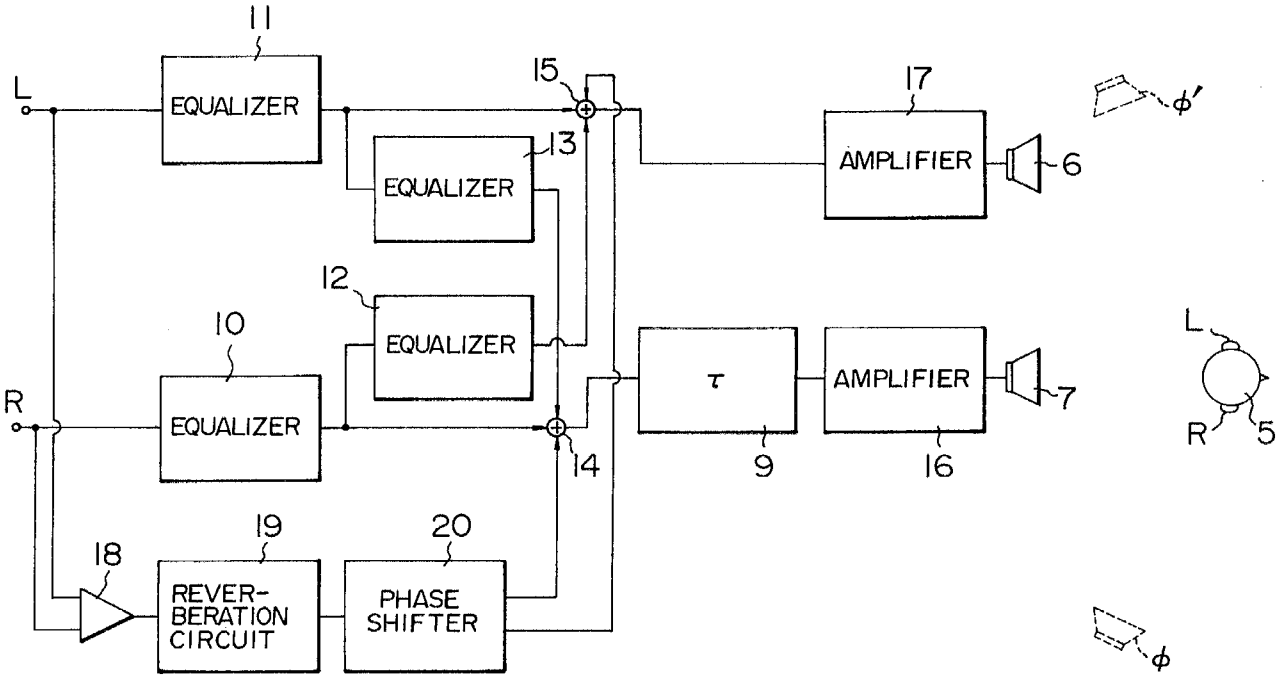
FIG. 4 is a block diagram of an embodiment of a sound reproduction system according to the invention.

FIG. 4 is an embodiment of the present invention constructed on the basis of the above-mentioned principle. In FIG. 4, reference numeral 10 designates an equalizer with a characteristic of $$\frac{H_{\phi R}}{H_{1R}};$$

11 an equalizer with a characteristic of $$\frac{H_{\phi L}}{H_{2L}};$$

12 an equalizer with a characteristic of $$\frac{H_{1R} \cdot H_{\phi L} - H_{1L} \cdot H_{\phi R}}{H_{2L} \cdot H_{\phi R} - H_{2R} \cdot H_{\phi L}};$$

13 an equalizer with a characteristic of $$\frac{H_{2L} \cdot H_{\phi R'} - H_{2R} \cdot H_{\phi L'}}{H_{1R} \cdot H_{\phi L'} - H_{1L} \cdot H_{\phi R'}};$$

9 a delay circuit for compensating for the difference in distance between the driver and the right and left speakers; 14 and 15 adders; 16 and 17 amplifiers.

In FIG. 4, the R-channel signal is applied to the adder 14 through the equalizer 10, and at the same time a part of the signal is applied through the equalizer 12 to the adder 15 of an L-channel signal. On the other hand the L-channel signal is applied to the adder 15 through the equalizer 11 and partially to the adder 14 through the equalizer 13. The two signals added by the adder 14 are applied to the speaker 7 through the delay circuit 9 and an amplifier 16. The two signals added by the adder 15 are applied to the speaker 6 through an amplifier 17. As a result, the driver 5 will feel an extended sound field as if the speaker 7 were located at an imaginary position $\phi$ and the speaker 6 were located at an imaginary position $\phi'$. In the present embodiment, the R-channel and L-channel signals are summed in an adder 18 and the adder signal is applied to a reverberation circuit 19 formed by a BBD or the like, to add reverberation. The reverberation signal is applied to a phase shifter 20. Upon receipt of the reverberation signal, the phase shifter 20 produces two reverberation signals of an opposite phase relation which are in turn applied to the adders 14 and 15, respectively. When the reverberation signals of opposite phases are applied to the respective channels, the sound produced provides a feeling of distance, so that the driver feels as if the speakers are disposed at a greater distance from him than they actually are.

Figure 5:
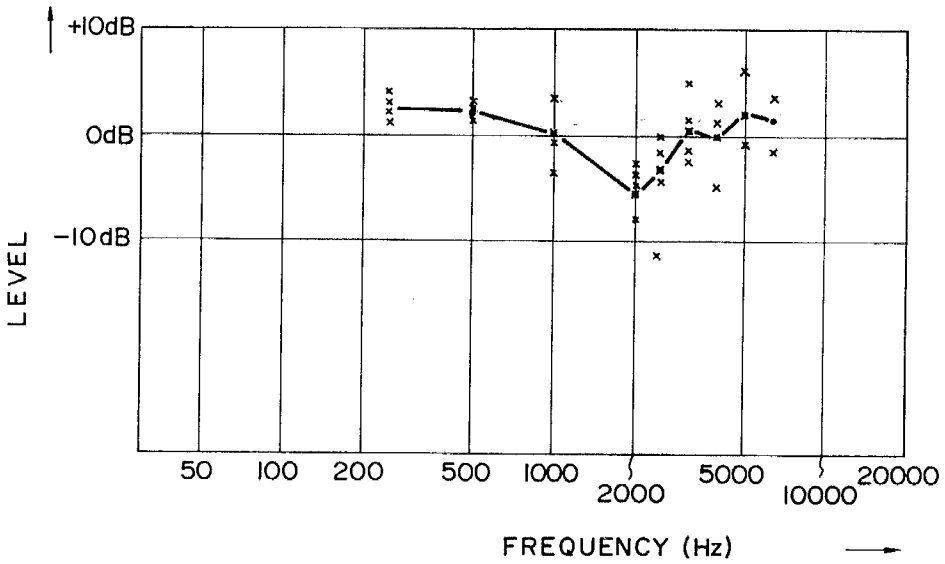
FIGS. 5 and 6 are level-frequency characteristics obtained by psychological experiments conducted to determine the characteristic of an equalizer used in the sound reproduction system according to the present invention.
Figure 6:
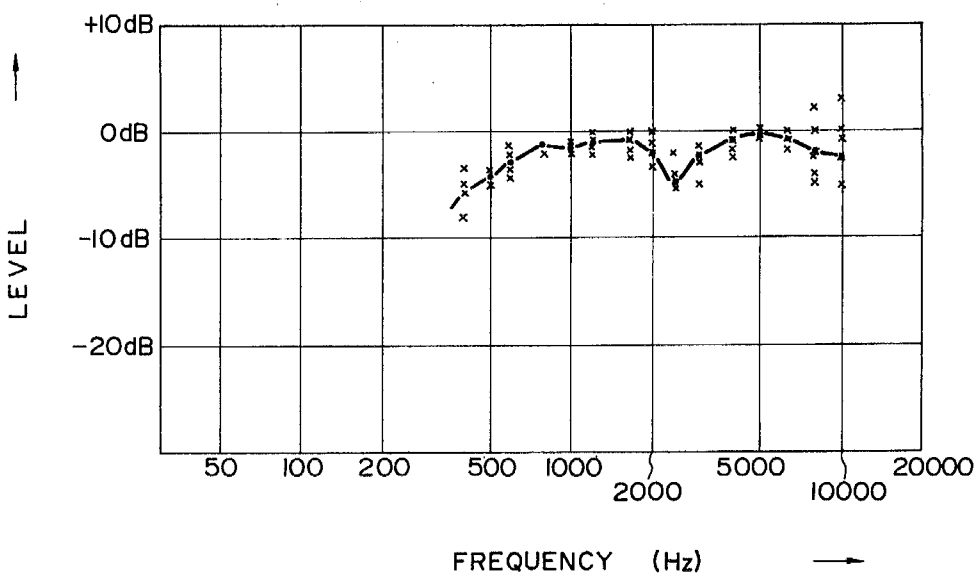

FIGS. 5 and 6 graphically represent an optimum level-frequency characteristic of the equalizer 12 which are obtained as the results of psychological experiments conducted by the sound reproduction systems according to this invention carried on with different vehicles. In the psychological experiments, variable resistors are used in place of the equalizers 12 and 13 shown in FIG. 4. While changing the resistance of the variable resistor connected in place of the equalizer 12, relationships between the signal levels and the frequencies are obtained at which a listener in the car feels that the sound field has been extended to a maximum amount. As seen from FIGS. 5 and 6, either of the sound reproduction systems carried on the different cars has a dip within a range of frequencies from 500 Hz to 5 KHz.

Figure 7:
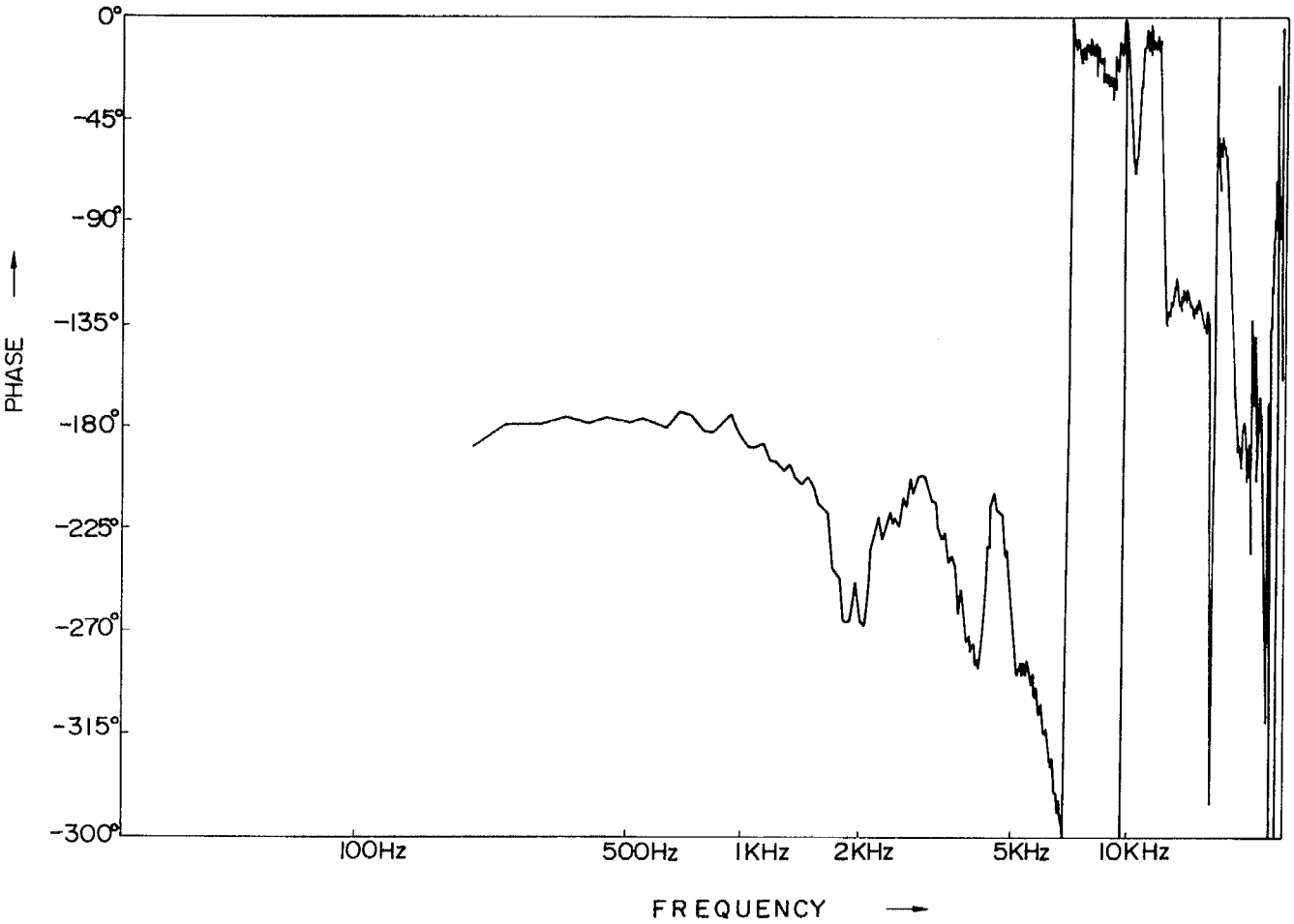
FIG. 7 is a graphical representation of a phase characteristic of the equalizer of the sound reproduction system.

In plotting a phase characteristic curve in FIG. 7, the equalizers 12 and 13 are substituted by delay lines each employing a BBD or the like, and phase-frequency relationships are obtained in which the sound field is extended by a maximum amount. As indicated in FIG. 7, the phase approximately keeps the opposite phase relation up to about 1 KHz and the phase is further delayed in frequencies higher than about 1 KHz.

As seen from the results of the experiments, the sound field is most extended with the use of equalizers 12 and 13 which have a level-frequency characteristic with a dip within the range of 500 Hz to 5 KHz, and have a phase characteristic in which the opposite phase relation continues up to near 1 KHz and the phase is further delayed beyond 1 KHz.

Figure 8:
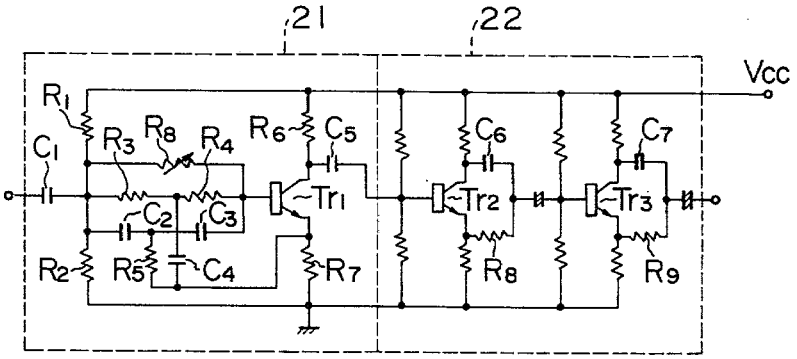
FIG. 8 is a circuit diagram of the equalizers used in the sound reproduction system according to an embodiment of the present invention.

FIG. 8 shows a circuit diagram for the equalizers 12 and 13. In the figure, reference numeral 21 designates a band-elimination filter and by this band-elimination filter, a phase characteristic having a dip between 500 Hz to 5 KHz is obtained. Reference numeral 22 is a phase shifter. By the use of this phase shifter 22, a phase relationship between the input and output of the circuit in FIG. 8 exhibits a phase characteristic in that the opposite phase relation continues up to near 1 KHz and the phase is further delayed in the frequencies exceeding about 1 KHz.

In FIG. 8, C1 designates an input coupling capacitor, R1, R2, R6 and R7 bias resistors for a transistor Tr1, R3, R4, R5, R8 and C2, C3 and C4 are resistors and capacitors for forming a parallel T circuit. The parallel T circuit constitutes a positive feedback circuit of the transistor Tr1. A signal output at one end of the resistor R7 is positively fed back to the base of the transistor Tr1 through the parallel T circuit. With such a circuit arrangement, the level-frequency characteristic with the dip between 500 Hz and 5 KHz as shown in FIGS. 5 and 6 is obtained. In FIG. 8, transistors Tr2 and Tr3, capacitors C6 and C7, resistors R8 and R9, etc., form a phase shifter having the phase characteristic shown in FIG. 7.

Figure 9:
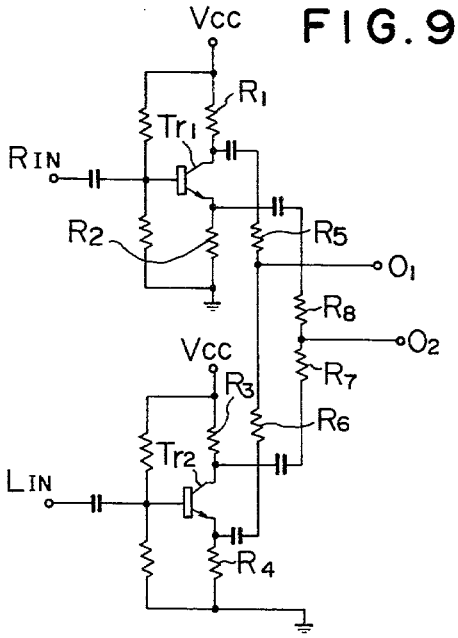
FIG. 9 is a circuit diagram of essential part of the sound reproduction system which is another embodiment according to the invention.

FIG. 9 shows a circuit for producing an indirect sound component such as reverberation contained in a 2 channel program source. The circuit shown in FIG. 9 may be used additionally coupled with the circuit of FIG. 4 or in place of the combination of the adder 18, the reverberation circuit 19 and the phase shifter 20. In FIG. 9, 2 channel input signals are applied to terminals $R_{IN}$ and $L_{IN}$. Through the collector resistors and emitter resistors R1, R3, R2 and R4 of the transistors Tr1 and Tr2, opposite-phased signals are obtained; one is delivered to an output terminal $O_1$ through resistors R5 and R6, the other is delivered to the other output terminal $O_2$ through resistors R7 and R8. When the resistors R5, R6, R7 and R8 have the following relations, L−0.7R and R−0.7L are obtained:

L−0.7R is obtained when R5:R6=1:0.7

R−0.7L is obtained when R7:R8=1:0.7

The above-mentioned embodiment is designed so as to provide a feeling of a sound region extention at the driver's seat, but may of course be designed to give the same effect at the assistant driver's seat or the rear seat or seats. The present invention is similarly applicable to a case where the speakers are disposed at the front right and left sides or the rear right and left sides in the car.

With the above-mentioned arrangement, the sound reproduction system of the invention provides a feeling of a widened sound field even in the passenger compartment.

What is claimed is:

1. A sound reproduction system for a motor vehicle which extends the sound field within a passenger compartment comprising:

a signal source for generating an input signal;

first and second loud-speakers spaced laterally from each other and disposed in the passenger compartment;

a transfer function converting circuit connected between said signal source and said first and second loudspeakers, said transfer function converting circuit including a first equalizer connected in common with both reproduction channels of said first and second loudspeakers and including a second equalizer connected to either one of the reproduction channels of said first and second loudspeakers, said first and second equalizers converting the transfer functions between both ears of a listener in the passenger compartment and said first and second speakers into different transfer functions between said listener and an imaginary third speaker located at a position at different directions from said first and second speakers such that sound pressures applied to both ears of said listener from said imaginary third speaker are equal to sound pressures applied to both ears of said listener from said first and second speakers;

a delay circuit connected between said transfer function converting circuit and said first and second speakers so that said delay circuit is inserted in one of two reproduction channels respectively leading to said first and second speakers, said delay circuit compensating for the difference between the distance from said first speaker to said listener and the distance from said second speaker to said listener; and a reverberation circuit for providing reverberation to the input signal from said signal source, said reverberation circuit being connected between said signal source and two output terminals of said transfer function converting circuit for respective reproduction channels for said first and second speakers so that the respective outputs of said transfer function converting circuit and the output of said reverberation circuit are added and applied respectively to said first speaker and said second speaker.

2. A sound reproduction system for a motor vehicle according to claim 1, wherein the second equalizer of said transfer function converting circuit includes a band-elimination filter with a dip between 500 Hz and 5 KHz, and a phase shifter for providing an opposite phase relation between the outputs applied to said first speaker and to said second speaker up to about 1 KHZ,the phase being further delayed beyond about 1 KHZ between the outputs applied to said first speaker and said second speaker.

3. A sound reproduction system according to claim 1, wherein said signal source supplies two channel input signals and said transfer function converting circuit further comprises a third equalizer and a fourth equalizer, said first and second equalizers having characteristics respectively defined by $$\frac{H_{\phi R}}{H_{1R}} \text{ and } \frac{H_{1R} \cdot H_{\phi L} - H_{1L} \cdot H_{\phi R}}{H_{2L} \cdot H_{\phi R} - H_{2R} \cdot H_{\phi L}},$$

and said third and fourth equalizers having characteristics respectively defined $$\frac{H_{\phi L}}{H_{2L}} \text{ and } \frac{H_{2L} \cdot H_{\phi R}' - H_{2R} \cdot H_{\phi L}'}{H_{1R} \cdot H_{\phi L}' - H_{1L} \cdot H_{\phi R}'},$$

where $H_{1R}$ and $H_{1L}$ are the transfer functions between said first speaker and right and left ears of said listener, $H_{2R}$ and $H_{2L}$ are the transfer functions between said second speaker and said right and left ears, $H_{\phi R}$ and $H_{\phi L}$ are transfer functions between a point located in a different direction from said first speaker and the right and left ears, and $H_{\phi R}'$ and $H_{\phi L}'$ are transfer functions between another point located in a different direction from said second speaker and the right and left ears, and wherein said first equalizer has an input terminal to receive an R channel input signal of the two channel input signal from said signal source, said first speaker is connected through said second equalizer to said first equalizer and said second speaker is connected through said delay circuit to said first equalizer, and wherein said third equalizer has an input terminal to receive an L channel input signal of the two channel input signal from said signal source, said first speaker is connected directly to said third equalizer, and said second speaker is connected through said fourth equalizer to said third equalizer.

4. A sound reproduction system according to claim 1, wherein said signal source supplies two channel input signals and said reverberation circuit is comprised of an adder for adding said two channel input signals, a reverberation applying circuit for applying reverberation to the added signal from said adder circuit, and a phase shifter for dividing the reverberation signal which corresponds to an output signal from said reverberation applying circuit into two parts thereby forming two reverberation signals having an opposite-phase relation, said two opposite phase reverberation signals in turn being applied to left and right channels.

* * * * *